US005827008A

United States Patent [19]

Smith et al.

[11] Patent Number: 5,827,008

[45] Date of Patent: Oct. 27, 1998

[54] PAVEMENT SEALING PRODUCT AND METHOD

[76] Inventors: Gerald R. Smith, #10—1925 Indian River Crescent, North Vancouver, B.C. V7G 2P7; Robert G. Gascoyne, 2713 Country Woods Dr., Surrey, B.C. V4A 9P8; Dieter Paul Sontowski, 230—8th Ave., New Westminster, B.C. V3L 1Y2, all of Canada

[21] Appl. No.: 494,007

[22] Filed: Jun. 23, 1995

[51] Int. Cl.[6] ..... E01C 11/02

[52] U.S. Cl. ..... 404/47; 404/74; 428/489

[58] Field of Search ..... 404/47, 64, 66, 404/70, 74, 73, 77, 79; 14/73.1; 428/40.3, 352, 489

[56] References Cited

U.S. PATENT DOCUMENTS

| | | | |
|---|---|---|---|
| 1,328,107 | 1/1920 | Waring | 404/66 |
| 1,742,650 | 1/1930 | Fischer | 404/64 |
| 3,632,418 | 1/1972 | Draper . | |
| 3,937,640 | 2/1976 | Tajima et al. | 428/489 X |
| 4,080,228 | 3/1978 | Currigan . | |
| 4,248,926 | 2/1981 | Tajima et al. | 428/489 X |
| 4,440,816 | 4/1984 | Uffner | 428/40.3 |
| 4,684,288 | 8/1987 | Chapa . | |
| 4,775,567 | 10/1988 | Harkness | 428/40.3 |
| 4,911,975 | 3/1990 | Schult | 428/489 |
| 4,992,315 | 2/1991 | Zickell et al. | 428/489 X |
| 5,142,837 | 9/1992 | Simpson et al. | 52/409 |
| 5,143,766 | 9/1992 | Wenz et al. | 428/40.3 |
| 5,206,079 | 4/1993 | Sanada et al. | 428/252 |
| 5,513,925 | 5/1996 | Dempsey et al. | 404/75 X |
| 5,525,399 | 6/1996 | Kiser | 428/141 |

FOREIGN PATENT DOCUMENTS 0343404 11/1989 European Pat. Off. .

OTHER PUBLICATIONS

Winn & Coales (Denso) Ltd. sales brochure entitled "Tok Road Products" consisting of compilation of documents bearing dates ranging from May, 1988 to Aug., 1993, pp. 1–66.

*Primary Examiner*—James Lisehora
*Attorney, Agent, or Firm*—Renner, Otto, Boisselle & Sklar, P.L.L.

[57] ABSTRACT

A pavement repair structure and method of repair for forming a bond between vertical surfaces in asphalt pavement. The repair structure comprises a flexible, internal layer that is impregnated with an adhesive asphalt medium to define an elongated strip. An additive agent is incorporated in the asphalt medium to reduce the tackiness and lower the temperature sensitivity of the asphalt medium. A cut in the asphalt pavement caused by either a saw or a jack hammer is sealed by using the repair structure to form an extremely strong bond between the vertical cut edge of the pavement and the patch of new asphaltic concrete mix. The repair structure is also able to form a bond which is waterproof and will resist cracking due to extreme temperatures as a result of severe climatic conditions, the thermal expansion and contraction which the pavement will experience, and deflection of the pavement under traffic loading. The pavement repair structure has a thickness of 10–15 mm, and a varying width, with a melting point such that when in contact with hot asphaltic cement at normal mixing temperatures, the surplus free asphalt contained in the pavement repair structure will flow into the voids of the cold surface on one side and will unite freely with the hot asphaltic mixture on the other side to create a homogeneous mass of all three components (the cold mixture in place, the pavement repair structure and the new hot asphaltic mixture being put in place).

20 Claims, 2 Drawing Sheets

PAVEMENT SEALING PRODUCT AND METHOD

FIELD OF THE INVENTION

This invention relates to a product and method for repairing and sealing cut joints in asphalt pavement.

BACKGROUND OF THE INVENTION

Asphalt pavements are commonly used in today's road systems. Asphalt pavements are known as flexible pavements in that they flex to varying degrees under traffic loading. Flexible pavements consist of an elaborate system of gravel base courses (layers) constructed directly on natural subgrade. The uppermost asphalt layer is designed to provide a smooth riding surface but does not add significantly to the strength of the total pavement structure. It is the gravel base courses that carry the traffic loads.

Millions of miles of asphaltic pavement have been constructed around the globe. These pavements represent a huge investment. In addition, huge sums of money are required to maintain the pavements world-wide. It is also estimated that there are two miles of cracks for every mile of pavement. These cracks consist of longitudinal, transverse and alligator cracks. Generally cracks are repaired by cutting and removing pavement from around the crack and refilling the removed area with new asphalt concrete mix.

As well, public utilities such as water mains, sewers, storm drains, gas mains are located directly under most street pavements and it is often necessary to cut the pavement to make various utility connections, repair breaks or replace old and outdated utilities.

It is important to repair and seal cracks and cuts as soon as possible to avoid infiltration of water into the gravel base which weakens the underlying structure of the road bed and leads to a breakdown of the total road structure.

When cuts in a pavement surface are repaired using conventional methods and materials, the repairs often fail and cracks develop or open up along the seam or joint of the cut. Conventional methods to repair cuts in pavement involve backfilling the cut area with suitable gravel and compacting it to an acceptable density. The cut edges of the existing pavement are painted with a asphalt tacking material such as a water based asphalt emulsion using a broom. The cut area is then patched with new asphaltic concrete hot mix and compacted to a suitable density. The tacking material is expected to create a waterproof, permanent join between the new asphaltic material and the existing material.

These conventional patch methods often fail as the bond between the generally vertical cut edge of the existing pavement and the new patch material is inherently weak even with the tacking material, particularly if the edge is cut using a diamond saw which produces a very smooth edge surface. Freezing and thawing cycles in winter and traffic loading contribute to the re-opening of the joints about the edges of the patch. It has been accepted in the industry that once the structural integrity of a pavement surface is breached by cuts, it is unlikely that the pavement can ever be properly repaired and returned to a state as strong as its original state.

Alternative methods for repairing pavement surfaces have been developed, however, these methods tend to rely on applying horizontally aligned patching materials over areas to be repaired. For example, U.S. Pat. No. 4,684,288 to Chapa discloses asphaltic pavement tiles that are laid flat over the surface needing repair. U.S. Pat. No. 4,080,228 to Currigan discloses a sealing product comprising an aggregate mix bonded to a mesh surface that positioned horizontally and glued over a surface to be covered. U.S. Pat. No. 3,632,418 to Draper discloses a fabric product that is impregnated with asphalt and a modifying agent. The fabric product is suitable for use as liner in a pond, as pavement surfacing in parking lots, driveways, play area surfaces, roofing or other covering or waterproofing material, or for molding to produce a molded body.

None of the prior art is directed to a product for joining and sealing the substantially vertical edges of cuts. These products tend to be more expensive that conventional patching material. They create a new pavement surface that overlaps or bridges the edges of a repaired area without joining the edges of the repaired area to the edges of existing pavement. The new pavement surface is subject to traffic loads and flexing of the pavement due to the traffic loads that causes eventual failure and reflective cracking of the patch material, particularly at the substantially vertical cuts.

SUMMARY OF THE INVENTION

Accordingly, there is a need for an asphalt repair product and repair method for generally vertical pavement cuts that provides a strong, waterproof and permanent bond between the cut edges of the existing pavement and the new asphalt material in the area being repaired.

There is also a need for an asphalt product that is easy to use and creates a strong and reliably bonded waterproof sealed joint between a generally vertical edge of an asphalt surface and the generally vertical edge of an adjacent surface.

The present invention provides an asphalt product and a method for using the product that addresses these needs.

The present invention provides a pavement repair structure for forming joints between generally vertical surfaces comprising, in combination:

- a thermoplastic, adhesive medium;
- an additive agent incorporated in the adhesive medium to reduce the tackiness and lower the temperature sensitivity of the medium; and
- a flexible base layer impregnated and covered with the adhesive medium and additive agent to define an elongate strip having an external coating of adhesive medium, the elongate strip being insertable between the generally vertical surfaces to be joined such that the external coating forms bonds with the opposite sides of the joint on the application of heat and the flexible base layer and impregnating asphalt medium co-operate to allow for repeated contractions and expansions of the joint.

In a preferred embodiment, the present invention provides a pavement repair structure for forming joints between surfaces in asphalt pavement comprising, in combination:

- an adhesive, asphalt medium;
- an additive agent incorporated in the asphalt medium to reduce the tackiness and lower the temperature sensitivity of the asphalt medium; and
- a flexible, fabric base layer impregnated and covered with the asphalt medium and additive agent to define an elongate strip having an external coating of asphalt medium, the elongate strip being insertable between the surfaces to be joined such that the external coating forms bonds with the opposite sides of the joint on the application of heat and the flexible, fabric base and impregnating asphalt medium co-operate to allow for repeated contractions and expansions of the joint.

In a further aspect, the present invention provides a method of creating a join between a cut pavement edge and the edge of a repaired area comprising the steps of:

providing a pavement repair strip comprising a geotextile base layer impregnated and coated with an asphalt cement and an additive compound to reduce tackiness and temperature sensitivity of the asphalt cement;

positioning the repair strip against the cut pavement edge; and filling and compacting the area to be repaired with hot asphaltic concrete material at a temperature sufficient to partially melt the asphalt cement of the repair strip such that the repair strip bonds with the edge of the cut pavement and the compacted asphaltic concrete material.

In a still further aspect, the present invention provides a method of forming a join between an asphalt pavement edge and a second edge comprising the steps of:

inserting a repair strip between the pavement edge and the second edge, the repair strip comprising a geotextile base layer impregnated and coated with an asphalt cement and an additive compound to reduce tackiness and temperature sensitivity of the asphalt cement;

applying heat to the strip to partially melt the asphalt cement coating of the repair strip such that the repair strip bonds with the asphalt pavement edge and the second edge.

The product and method of the present invention create a waterproof pavement joint that is able to withstand a wide range of temperature fluctuations and continual contraction and expansion stresses.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
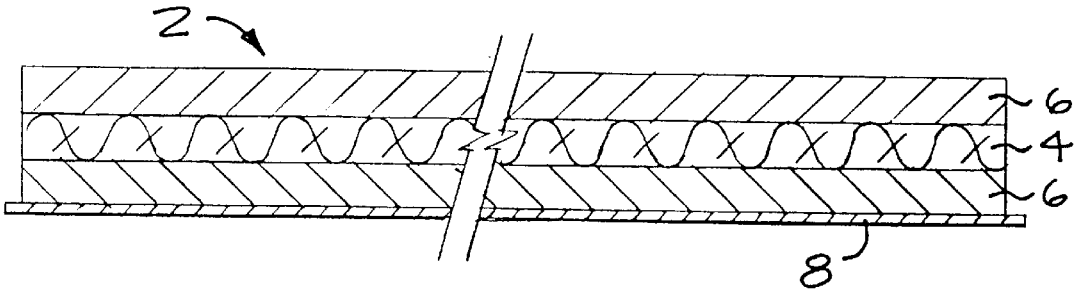
FIG. 1 is a transverse section view through a repair strip according to a preferred embodiment of the present invention.

Referring to FIG. 1, there is shown a preferred embodiment of the pavement repair structure of the present invention. FIG. 1 is a lateral cross-section showing the internal organization of the repair structure which is in the form of an elongate strip 2. Strip 2 is formed from an interior flexible, fabric base layer 4 impregnated and coated with an adhesive, asphalt medium 6. Fabric layer 4 is shown schematically as a discrete layer in FIG. 1, however, the fabric layer is fully impregnated with asphalt medium 6. The adhesive, asphalt medium is modified by an additive agent incorporated in the asphalt medium 6 to reduce the tackiness and lower the temperature sensitivity of the asphalt medium. Together, the flexible, fabric base layer 4, the adhesive, asphalt medium 6 and the additive agent define an elongate strip that is placed against a generally vertical surface to create a join or bond between the vertical surface and a hot asphaltic concrete material that is brought into contact with the elongate strip. Preferably, strip 2 is provided with a removable or peelable backing layer 8 applied to a flat, longitudinal surface of the strip. The backing layer allows the strip 2 to be rolled or packed into a spool of material for convenient handling, storage and dispensing.

The strips of the present invention are preferably produced by dipping sheets of fabric base layer 4 in heated vats containing the liquid asphalt medium modified by an additive agent. The fabric layer is impregnated and coated with the asphalt medium and allowed to cool whereupon the sheets are cut into strips of various lengths and widths suitable for various applications.

FABRIC MEDIUM

Preferably, flexible, fabric base layer 4 comprises a non-woven, needle punched, puncture resistant polyester geotextile. For example, the geotextile product sold by Hoechst Celanaese Corporation under the trademark Trevira is a suitable base layer 4. In particular, the Trevira spunbound Type 11 products offer excellent high tensile strength with good dimensional stability when subject to grab elongation. The Type 11 products also exhibited good tear strength, puncture resistance and Mullen burst strength when impregnated and coated with the asphalt medium. Typical physical properties of the Type 11 products are shown in the accompanying Table 1 as supplied by the manufacturer.

TABLE 1

Typical Physical Properties of Trevira Type II Products

| Fabric Properties | Unit | 125 | 1135 | 1145 | 1155 |
|---|---|---|---|---|---|
| Fabric Weight | $g/m^2$ | 250 | 350 | 450 | 550 |
| Thickness | mm | 2.8 | 3.5 | 4.3 | 5.3 |
| Grab Strength (MD/CD) | N | 1334/1045 | 1867/1556 | 2900/2000 | 2890/2539 |
| Grab Elongation (MD/CD) | % | 75/85 | 75/80 | 80/80 | 85/85 |
| Mullen Burst Strength | kPa | 2760 | 3864 | 4830 | 5900 |

It was found that grades 1145 and 1155 were dimensionally stable and could be dipped in vats of hot liquid asphalt without any marked distortion of the sheets. This was due to the fact that grab elongation in the machine direction and cross direction were substantially the same. Lighter 1125 and 1135 grades distorted significantly in the cross direction requiring that the lighter grades be pre-treated by impregnation with a resin or other material to give them dimensional stability suitable for dipping and drawing through the vats of hot asphalt medium. One economical dimensional stabilizer was a flour-water paste of suitable viscosity.

Polypropylene fabrics are an alternative fabric medium. Polypropylene fabrics manufactured by Amoco Fabrics and Fibres Ltd. of Pointe Claire, Quebec under the trademark Amopave were found to be suitable for use in the strip of the present invention. The polypropylene material suffered from the disadvantages that it lacked some dimensional stability, particularly in the cross machine direction, and it would melt if exposed to an asphalt medium at a temperature of greater than 300 degrees Fahrenheit. It was found that dimensional stability could be improved by first impregnating the polypropylene material with a flour-water paste and letting it dry. Impregnating and coating the polypropylene fabric could only be done in asphalt mediums at temperatures of less than 300 degrees Fahrenheit. However, if the polypropylene fabric was first coated with a lower temperature asphalt medium below 300 degrees Fahrenheit, allowed to cool, and then dipped in asphalt medium at greater than 300 degrees Fahrenheit, meltdown of the polypropylene could be prevented.

A wide variety of alternative base layers may be used in the strip of the present invention. Any synthetic or natural layer that is flexible and can be impregnated and coated with a hot asphalt medium is usable as a base layer. For example, woven plastic or fibreglass base layers are possible. Some of these alternative base layers would have to be stabilized with resins or flour-water paste to make it possible to draw them through vats of hot liquid asphalt.

ASPHALT MEDIUM

An important feature of the repair strip of the present invention is the adhesive, asphalt medium. This medium must have a lowered temperature susceptibility and reduced tackiness for ease of handling, but at the same time it must be capable of good adhesion to the surfaces it is joining on the application of heat.

Preferably, the adhesive asphalt medium used in the strip of the present invention comprises a paving grade asphalt cement having a penetration rating of 85–100. The characteristics of such an asphalt cement are listed in Table 2 that follows:

TABLE 2

85–100 Penetration Grade Asphalt

| Specifications | Min. | Max. |
|---|---|---|
| Viscosity @ 60 Degrees C., Pa/s | 65 | 95 |
| Penetration @ 25 Degrees C. (100 g/5 s) | 85 | 100 |
| Ductility @ 25 Degrees C. (5 cm/min) cm | 100 | — |
| Flash Point, c.o.c., min. Degrees C. | 235 | — |
| Solubility in Trichloroethylene, % | 99 | — |
| Water, % | — | 0.5 |
| Specific Gravity @ 25 Degrees C. | 1.0 to | 1.2 |

Other suitable grades of asphalt cement graded by penetration are 40–50, 60–70, 120–150 and 200–300 where the higher the range, the softer the asphalt cement. Alternatively, asphalt cement is available graded by viscosity at 140 degrees Fahrenheit. Examples of suitable asphalt cements graded by viscosity include AR 1000, AR 2000, AR 4000, AR 8000 and AR 16000 where the higher the number, the more viscous the asphalt cement.

The foregoing paving grade asphalt cements are liquid at 300 degrees Fahrenheit and can be used to impregnate and coat both polyester geotextile fabrics and polypropylene geotextiles.

Oxidized roofing asphalt is an alternative adhesive asphalt medium for impregnating the fabric layer of the present invention. In testing, Type II oxidized roofing asphalt was found to perform well. Typical characteristics of Type II oxidized roofing asphalt are shown in Table 3 that follows:

TABLE 3

Type II Oxydized Roofing Asphalt

| Specification | Min. | Max. |
|---|---|---|
| Penetration @ 25 Degrees C. (100 g/5 s) | 20 | 30 |
| Ring and Ball Softening Point, Degrees C. | 75 | 83 |

TABLE 3-continued

Type II Oxydized Roofing Asphalt

| Specification | Min. | Max. |
|---|---|---|
| EVT Range | 191 (+/−13) | |
| Flash Point, c.o.c., Degrees C. | 230 | |
| Solubility in Trichloroethylene, % | 99 | |
| Specific Gravity @ 25 Degrees C. | 1.0 to | 1.2 |

Oxidized roofing asphalt is maintained in a liquid state at a temperature of 380 degrees Fahrenheit. Therefore, roofing asphalt is suitable for impregnating the polyester geotextiles. The polypropylene geotextiles have to be pre-treated with the flour water paste or other suitable product as described above to withstand immersion in the hotter roofing asphalt mix.

While paving grade asphalt cements are preferred as the adhesive medium in the repair strip of the present invention, it is understood that other thermoplastic, adhesive materials can be used as the adhesive medium. As long as the thermoplastic material in a solid state can be liquified by heating to impregnate and coat the flexible base layer and is capable of forming a bond with a cut pavement edge, it is suitable for use in the repair strip of the present invention. It is anticipated that so called hot melt products consisting of various resins and waxes can be used as the adhesive medium of the present invention.

Examples of suitable adhesive compositions include products known in the packaging industries as hot-melts. Many hot-melt adhesives contain synthetics such as polyethylene combined with various quantities of resin and/or waxes. Other hot-melt adhesives contain ethylene vinyl acetate in combination with various amounts of resin and/or waxes. One such product is manufactured by Nacan Products Ltd. and sold under the trademark INSTANT-LOK. These examples are not limiting as many others may be used.

ADDITIVE AGENT

Ground Styrene Butadiene Rubber (SBR) was added to the asphalt medium in order to lower the temperature susceptibility and reduce the tackiness of the asphalt in the impregnated repair strip. SBR as an additive agent improved the handling characteristics of the strip while allowing for excellent adhesion of the repair strip to the substantially vertical pavement surfaces being joined. Both paving grade asphalt cement and oxidized roofing asphalt were modified by adding finely ground SBR. It was determined that finely ground SBR (30 mesh) provided good results. Other coarser grinds of SBR are also acceptable as a modifying agent. The ground SBR was added to the asphalt medium in varying amounts up to 50 per cent by weight of the mix to produce a modified impregnating asphalt medium having desirable characteristics with respect to tackiness, temperature susceptibility and adhesion to surfaces.

The modified asphalt medium used with the repair strip of the present invention is intended to have a melting point preferably somewhat lower than 270 degrees Fahrenheit. When the strip comes into contact with hot asphaltic concrete material, which is generally maintained at a temperature over 270 degrees Fahrenheit, the excess asphalt medium of the strip will melt and flow to create a bond with the edges of the surfaces being joined by the strip.

It will be readily apparent to those skilled in the art that other additive agents besides ground SBR can be used with the asphalt medium of the present invention to reduce the tackiness and temperature sensitivity. Examples of alternative additive agents include: fly ash, hydrated lime, Portland cement powder. There are many other known additives which can be suspended in the hot liquid asphalt medium and after the colloidal structure so as to make the asphalt medium of the present invention less tacky and less temperature sensitive.

USES OF THE INVENTION

A repair strip according to the present invention finds application in a number of different situations as described below.

Figure 3:
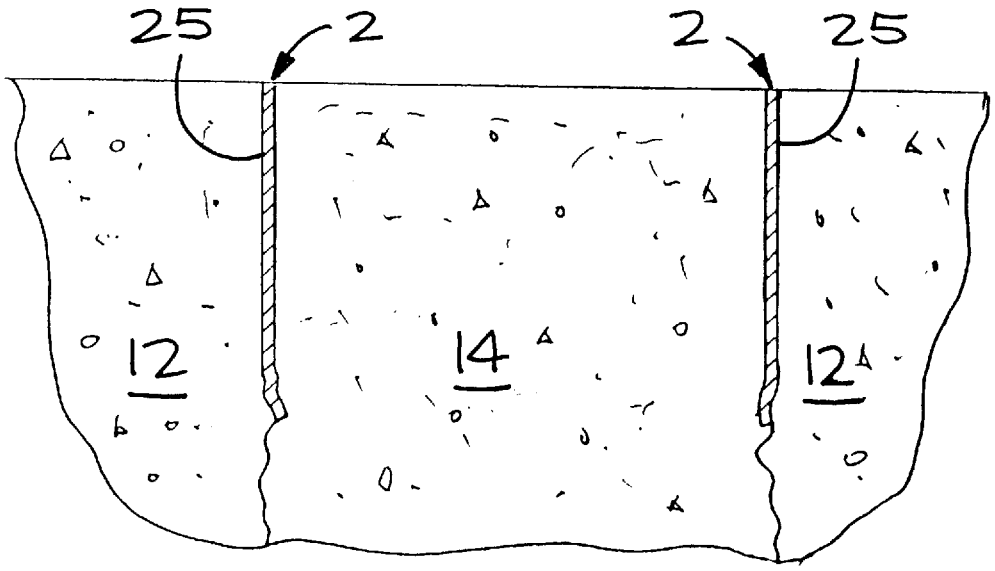
FIG. 3 is a section view through a repaired area in an existing asphalt pavement surface showing the manner in which the repair strip is used to create a flexible, waterproof seal between the repaired area and the existing pavement.

FIG. 3 shows the repair strip 2 of the present invention being used to create a waterproof bond between the edges 25 of a cut pavement 12 and the edges of a repaired area 14. The need for a repaired area 14 occurs when cuts are made in existing pavement to access buried utilities or when cuts are made about cracked or damaged areas in the pavement in order to perform repairs.

Cuts are made with saws or jackhammers to establish generally vertical edges 25 in the existing asphalt pavement that define a work area. Material is then removed from the work area creating a void in the pavement surface that will eventually have to be repaired.

To restore the pavement surface, it is first necessary to prepare the gravel base courses by compacting to create a solid foundation for the repair material. The substantially vertical edges 25 of the cut pavement may have to be cleaned to remove any loose debris. Repair strips 2 according to the present invention are then placed against the vertical edges of the cut pavement to create a continuous strip about the area to be repaired. Repair strips 2 are placed so that they do not extend above the cut edge of the pavement. If necessary, they may be trimmed to the correct dimension. Preferably, the repair strips are loosely secured to the cut edge to hold them in place. This is accomplished by spot tacking the repair strip to the vertical edge 25 of the cut pavement using asphalt based or other suitable tacking material.

The work area is then filled with a conventional hot asphaltic concrete mix. The temperature of the newly added asphaltic concrete mix is sufficient to partially melt the excess asphalt cement of the repair strip such that the repair strip bonds with the generally vertical edges 25 of the cut pavement and the edges of the area to be repaired. The mix is then levelled and compacted.

Figure 4:
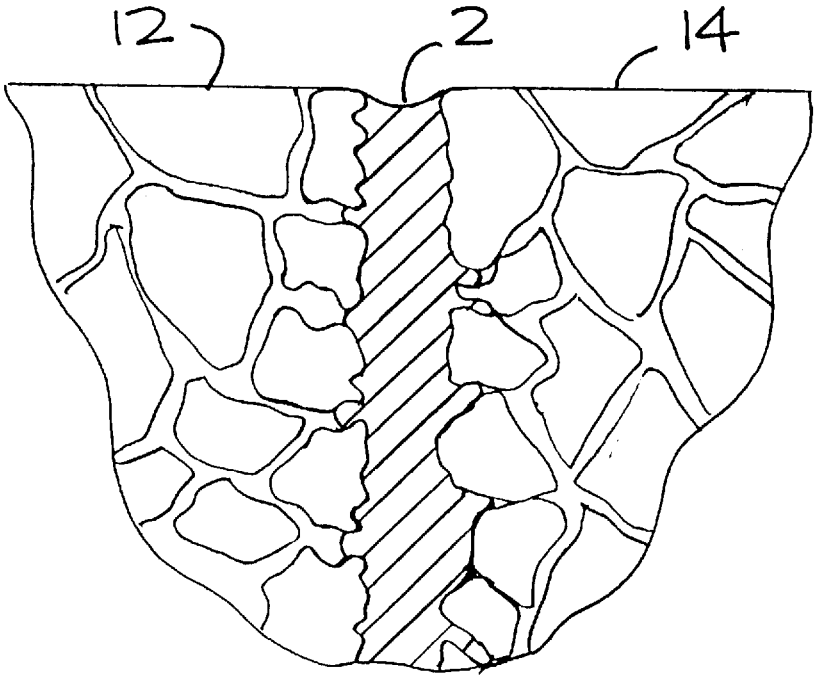
FIG. 4 is a detail view of the repair strip in position showing the manner in which the excess asphalt cement coating the repair strip bonds with the edges to be joined.

FIG. 4 is a detail view of the manner in which repair strip 2 forms a waterproof bond with the generally vertical edges of the cut pavement 12 and the hot asphaltic concrete in the repaired area 14. The excess asphalt medium coating the repair strip melts, flows and fills the voids in cut pavement edge 25 and the hot mix to create an extremely strong bond between two surfaces. Capillary action draws the flowable asphalt medium into the voids of the edges to create the necessary bonds.

In general, the repair strip 2 of the present invention finds application as a bonding material between any two substantially vertical edges in a road surface. For example, currently, streets constructed with concrete curbs and gutters are tack coated with various asphalt emulsions to facilitate better bonding between the concrete curb/gutter structure and the asphaltic concrete mix that is installed to create the actual road surface between the curbs. Repair strip 2 of the present invention can be installed between the Portland cement concrete of the curb/gutter and the asphaltic concrete mix that forms the road surface to create a waterproof, flexible bond between the two materials.

During paving operations of large areas, it is customary to apply asphaltic concrete in mats. The repair structure of the present invention can be used to form a bond between adjacent asphaltic concrete mats.

Figure 2:
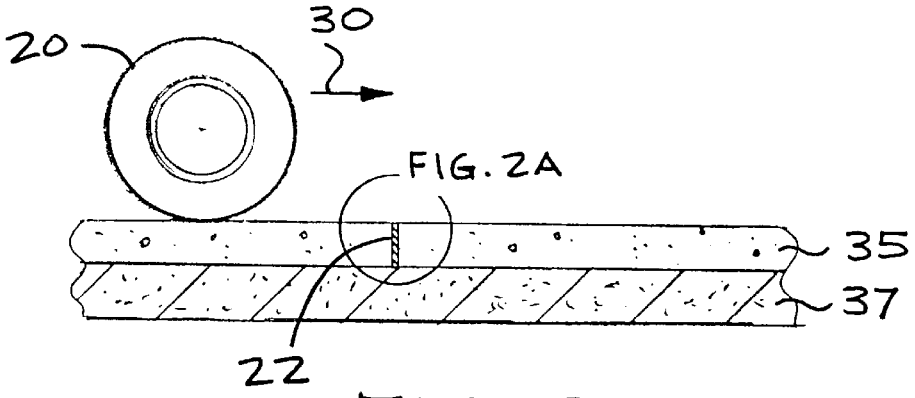
FIG. 2 is a schematic view showing the stresses that a transverse joint in a road surface experiences.
Figure 2A:
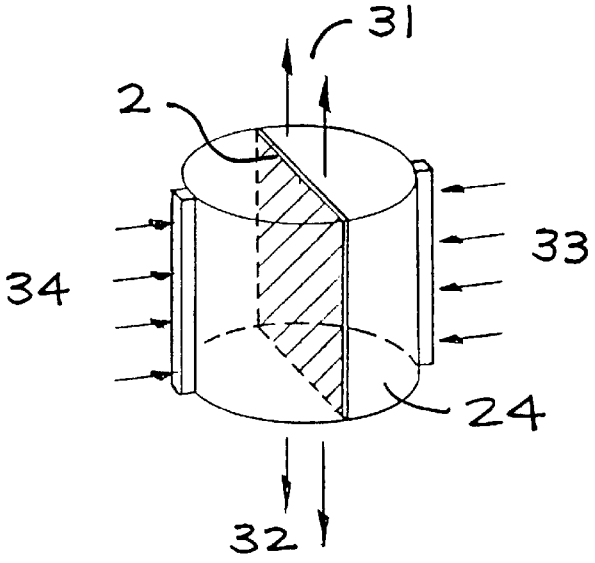
FIG. 2A is a detail view of a core segment through a joint formed with the repair strip of the present invention showing the stresses to which the joint is subjected.

Testing of joints formed using the repair strip of the present invention has been conducted by taking 100 mm diameter core samples through jointed pavements. Similar test cores have been taken from homogeneous pavement and pavement joined by conventional hot asphalt tack methods. The cores were tested at 25° C. by means of the Indirect Tensile Test (ASTM D4123). FIG. 2 shows the manner in which the indirect tensile tests simulates the loading that a road surface is subjected to normally. The road surface comprises an asphalt pavement layer 35 atop a gravel base course 37. A car wheel 20 passing over a joint 22 in layer 35 in the direction indicated by arrow 30 places compressive and tensile loads on the joint. This loading is paralleled by the normal compressive load and tensile loads placed on a core sample 24 during indirect tensile tests. FIG. 2A is a detail view of the core sample 24 in which arrows 34 shows the compressive loads to which the core is subjected. Arrows 33 show the reaction load exerted by the pavement layer. Arrows 31 and 32 indicate the tensile stresses that the core experiences.

The test results are indicated in Table 4 where specimen type 1 is a control core through a homogeneous pavement, specimen type 2 is a core through joints formed with a hot asphalt cement tack and specimen type 2 is a core through a joint according to the repair strip of the present invention.

TABLE 4

Indirect Tensile Test Results

| SPECIMEN TYPE (AVERAGE of 3) | MEASURED (St) STRENGTH (MPa) | MEASURED STRAIN (E) AT FAILURE (%) | STIFFNESS (Es) MODULUS (MPa) |
|---|---|---|---|
| 1 | 1.52 | 2.2 | 69 |
| 2 | 1.54 | 2.6 | 59 |
| 3 | 1.55 | 1.0 | 155 |

STIFFNESS MODULUS, Es = St/E

The test results indicate that all core specimens achieved similar strengths of about 1.5 MPa, however, the measured strengths correspond to different measured strains with the core containing a joint according to the present invention deforming the least at failure. The Stiffness Modulus $E_s$ indicates the relationship between measured strength and failure strains and therefore is an appropriate way of comparing the strength characteristics of materials. Table 4 shows that while the homogenous core and asphalt tack core specimens have stiffnesses of 69 and 59 MPa, respectively, the core specimen using the repair strip of the present invention has a stiffness modulus of twice as much at 155 MPa. These results indicate that the repair strip of the present invention offers significantly improved performance of a joint structure in a flexible asphalt pavement as compared to conventional tack techniques. The repair strip of the present invention provides a highly crack resistant waterproof bond and effective seal for the joining of pavement edges.

Although the present invention has been described in some detail by way of example for purposes of clarity and understanding, it will be apparent that certain changes and modifications may be practised within the scope of the appended claims.

We claim:

1. A pavement repair structure for sealing joints between surfaces in asphalt pavement, comprising:

an adhesive, asphalt medium; and a reinforcing layer having a thickness greater than 3.5 mm that is impregnated and covered with the asphalt medium to define an elongate strip having an external coating of asphalt medium, the elongate strip being installable between the surfaces to be joined such that the external coating forms bonds with the opposite surfaces on the application of heat and the reinforcing layer and impregnating asphalt medium cooperate to allow for repeated contractions and expansions of the joint without separation of the surfaces one from the other.

2. A pavement repair structure as claimed in claim 1, including a removable backing layer applied to the elongate strip.

3. A pavement repair structure as claimed in claim 1 in which the reinforcing layer comprises a flexible fabric.

4. A pavement repair structure as claimed in claim 1 in which the reinforcing layer has a thickness greater than 4.3 mm.

5. A pavement repair structure as claimed in claim 4 in which the reinforcing layer has a fabric weight greater than 450 $g/m^2$.

6. A pavement repair structure as claimed in claim 4 wherein the reinforcing layers has a grab strength greater than 2900N in the machine direction and greater than 2000N in the cross direction.

7. A pavement repair structure as claimed in claim 1 in which the reinforcing layer comprises a polyester geotextile.

8. A pavement repair structure as claimed in claim 1 in which the adhesive asphalt medium comprises a penetration grade asphalt cement.

9. A pavement repair structure as claimed in claim 8 in which the asphalt cement is in the range of a 40–120 penetration grade asphalt cement.

10. A pavement repair structure as claimed in claim 1 in which the reinforcing layer comprises a polypropylene fabric.

11. A pavement repair structure as claimed in claim 1 including a stabilizing medium to impregnate the reinforcing layer to ensure that the reinforcing layer maintains its shape.

12. A pavement repair structure as claimed in claim 1 including an additive agent incorporated in the asphalt medium to reduce the tackiness and lower the temperature sensitivity of the asphalt medium.

13. A pavement repair structure as claimed in claim 12 in which the additive agent comprises ground styrene butadiene rubber (SBR).

14. A pavement repair structure as claimed in claim 12 containing up to about 50 percent by weight of ground styrene butadiene rubber.

15. A pavement comprising pavement sections having adjacent vertical edges, and the pavement repair structure as claimed in claim 1 installed in place between the vertical edges to form a sealed joint.

16. A pavement as claimed in claim 15, in which the vertical edge of one of the pavement sections has voids into which has flowed the asphalt medium of the pavement repair structure, thereby to create a strong bond.

17. A pavement as claimed in claim 15 in which the reinforcing layer comprises a flexible non-woven fabric.

18. A pavement as claimed in claim 15 in which the reinforcing layer has a thickness greater than 4.3 mm.

19. A pavement as claimed in claim 15 in which the reinforcing layer has a fabric weight greater than 450 $g/m^2$.

20. A pavement repair structure for sealing joints between generally vertical surfaces, comprising:

a thermoplastic adhesive medium; and a reinforcing layer having a thickness greater than 3.5 mm that is impregnated and covered with the adhesive medium to define an elongate strip having an external coating of adhesive medium, the elongate strip being installable between the generally vertical surfaces to be joined such that the external coating forms bonds with the opposite surfaces on the application of heat and the reinforcing layer and impregnating adhesive medium cooperate to allow for repeated contractions and expansions of the joint without separation of the surfaces one from the other.

* * * * *